US012780360B2

(12) United States Patent
Kaijala

(10) Patent No.: US 12,780,360 B2
(45) Date of Patent: Nov. 3, 2026

(54) FORWARD FACING BIMINI

(71) Applicant: Lippert Components, Inc., Elkhart, IN (US)

(72) Inventor: Murray Kaijala, Elkhart, IN (US)

(73) Assignee: LIPPERT COMPONENTS, INC., Elkhart, IN (US)

( * ) Notice: Subject to any disclaimer, the term of this patent is extended or adjusted under 35 U.S.C. 154(b) by 272 days.

(21) Appl. No.: 18/775,514

(22) Filed: Jul. 17, 2024

(65) Prior Publication Data

US 2025/0026448 A1 Jan. 23, 2025

Related U.S. Application Data

(60) Provisional application No. 63/527,865, filed on Jul. 20, 2023.

(51) Int. Cl.
*B63B 17/02* (2006.01)

(52) U.S. Cl.
CPC ..... *B63B 17/02* (2013.01)

(58) Field of Classification Search
CPC ..... B63B 17/02
See application file for complete search history.

(56) References Cited

U.S. PATENT DOCUMENTS 4,951,594 A 8/1990 Feikema
7,389,737 B1 * 6/2008 Schwindaman ..... B63B 17/02 114/361
7,438,015 B1 * 10/2008 Schwindaman ..... B63B 17/02 114/361
7,921,797 B2 4/2011 James
8,297,484 B2 10/2012 Jesewitz et al.
8,752,498 B1 6/2014 Schwindaman et al.
9,114,854 B2 8/2015 Williams et al.
9,434,451 B1 9/2016 Ostmeyer et al.
9,783,266 B2 10/2017 Hough
9,815,525 B2 11/2017 Hough
9,849,939 B2 12/2017 Hough et al.
(Continued)

OTHER PUBLICATIONS

Manitou Forward Fold Bimini, 2024 Manitou Explore: Recreational Pontoon Boat (manitoupontoonboats.com), website pages, printed out Jul. 17, 2024, origination date unknown, 12 pp.
(Continued)

*Primary Examiner* — Richard G Davis
(74) *Attorney, Agent, or Firm* — NIXON & VANDERHYE P.C.

(57) ABSTRACT

A combined radar arch and bimini top assembly includes a radar arch pivotable between a stowed position and a radar position, and a bimini arm cooperable with the radar arch. The bimini arm is pivotable with the radar arch between the stowed position and the radar position and to an extended position. A canopy is connected between the bimini arm and the radar arch, and a drive system engages the bimini arm to drive the bimini arm among the stowed, radar and extended positions. The radar arch is biased by a bias force toward the radar position, and the bimini arm displaces the radar arch from the radar position to the stowed position against the bias force. The radar arch and the bimini arm are thus individually actuated while also being used in tandem to deploy the canopy, the radar arch, and the bimini arm.

17 Claims, 8 Drawing Sheets

(56) References Cited

U.S. PATENT DOCUMENTS

| | | | | |
|---|---|---|---|---|
| 10,286,982 | B2 * | 5/2019 | Sheedy | B63B 17/02 |
| 10,858,072 | B1 * | 12/2020 | Riordan | B63B 17/02 |
| 11,046,394 | B1 | 6/2021 | Ritchel et al. | |
| 11,472,512 | B1 | 10/2022 | Ritchel et al. | |
| 11,518,480 | B1 | 12/2022 | Ritchel et al. | |
| 2006/0124045 | A1 | 6/2006 | Tucker et al. | |
| 2021/0323639 | A1 | 10/2021 | Ward et al. | |
| 2022/0161896 | A1 | 5/2022 | Morgan et al. | |
| 2022/0234688 | A1 * | 7/2022 | Messick | B63B 17/02 |

OTHER PUBLICATIONS

NautiqueParts, Bimini Top Lift Support Nautique, https://nautiqueparts.com/bimini-top-lift-support-nautique/, website pages, printed out Jul. 17, 2024, origination date unknown, 2 pp.

Sea Ray Boat Folding Wakeboard Tower | 95 x 51 1/4 x 35 Inch | eBay, website pages, printed out Jul. 17, 2024, origination date unknown, 6 pp. https://www.ebay.com/itm/144645848454?chn=ps&_trkparms=ispr%3D1&amdata=enc%3A1XZhocB_fSwaeYLOHvT6QoQ25&norover=1&mkevt=1&mkrid=711-117182-37290-0&mkcid=2&mkscid=101&itemid=144645848454&targetid=1644837434323&device=c&mktype=&googleloc=9016255&poi=&campaignid=16743749222&mkgroupid=138744546207&rlsatarget=pla-1644837434323&abcId=9300842&merchantid=6307714&gclid=EAIaIQobChMItPSH_86u_QIVVGpvBB23fwtQEAYYBCABEgJHyfD_BwE.

Barletta Arch, https://www.youtube.com/watch?v=yMa2IvehMPA, The Beautiful Barletta Arch—YouTube, origination date unknown, 2 pp.

* cited by examiner

FORWARD FACING BIMINI

CROSS-REFERENCES TO RELATED APPLICATIONS

This application claims the benefit of U.S. Provisional Patent Application No. 63/527,865, filed Jul. 20, 2023, the entire content of which is herein incorporated by reference

STATEMENT REGARDING FEDERALLY SPONSORED RESEARCH OR DEVELOPMENT (NOT APPLICABLE)

BACKGROUND

The invention relates to a bimini top in combination with a forward facing radar arch and, more particularly, to the combination where the forward leaning radar arch is actuated with a strut and the bimini arm is actuated with a drive system.

In recreational boating, a so-called "bimini top" is a convertible cover erected upon the deck of the boat and made to be deployed at an elevation comfortably above the heads of the passengers. Drawing its name from the Bimini Islands in the Bahamas where it was first employed by boaters to provide desired shade from the strong rays of the tropical sun, the standard type of bimini top generally includes a flexible canvas material secured to a foldable support frame that is erected across the deck and is pivotally attached. These standard types of foldable bimini tops can be raised when needed or lowered into a substantially flat position on the deck when not in use or when an overhead obstruction may otherwise require it to be lowered.

Existing framework generally used to construct present bimini top installations includes a system of poles or like rigid members mounted to the port and starboard sides of the boat and made to extend across the deck at a sufficient height level to support the canvas top above the occupants. As currently arranged and implemented, these pole systems typically have separate front and rear pole members over which the canvas top is extended and, depending on the length of the top from fore to aft, one or more additional pole members between the front and rear poles to firmly support the intermediate section of the top.

Separately, radar arches have become quite popular and are attached to, and upwardly extend from, the deck or superstructure (such as a flybridge) of boats. These radar arches are useful for attaching antennas and radar systems thereto. Deck lights and stereo speakers are also typically found connected to these radar arches. However, despite their relatively high expense, very little additional utility has been made of radar arches. In fact, on many boats which include both convertible tops and radar arches, the two are completely free standing one to another thus having the appearance of a discontinuity of design.

SUMMARY

The combined radar arch and bimini top assembly of the described embodiments mounts to the boat in an opposite orientation and the open/close/radar positions are "backward" from a conventional bimini design. The assembly provides a radically different appearance that is intended to be appealing to discriminating boat manufacturers. When the bimini is in the radar position, the assembly mimics the appearance of a more expensive radar arch.

With the assembly of the described embodiments, the radar arch and the bimini arm are individually actuated but are used in tandem to deploy the bimini canopy, the radar arch and the bimini arm.

In an exemplary embodiment, a combined radar arch and bimini top assembly includes a radar arch securable on a boat deck that is pivotable between a stowed position and a radar position, and a bimini arm cooperable with the radar arch and securable on the boat deck. The bimini arm is pivotable with the radar arch between the stowed position and the radar position, and the bimini arm is further pivotable to an extended position. A canopy is connected between the bimini arm and the radar arch, and a drive system coupled with the bimini arm engages the bimini arm to drive the bimini arm among the stowed, radar and extended positions. The radar arch is biased by a bias force toward the radar position, and the bimini arm displaces the radar arch via the drive system from the radar position to the stowed position against the bias force.

The assembly may further include a biasing structure that applies the bias force to the radar arch. The assembly may include a boot that covers the radar arch, the bimini arm, and the canopy, and when the boot is installed, the bimini arm may be pivotable only between the stowed position and the radar position.

The assembly may further include a base to which the radar arch and the bimini arm are mounted and in which the drive system may be housed, where the radar arch may be connected to the base via a pivot pin. In this context, the assembly may also include a gas strut that applies the bias force to the radar arch, where the gas strut is connected between a forward end of the radar arch and the base. The radar arch may be connected to the base with an end pin spaced from the pivot pin, where the end pin includes a handle to define a quick release pin. The base may include a front closure disposed forward of the radar arch that covers a gap at a front of the base. The front closure may be pivotable between an upright position and a collapsed position, and the front closure may be biased toward the upright position via a spring.

A proximal end of the bimini arm may include a bend that corresponds to a convex region of a proximal rearward end of the radar arch such that the bimini arm and the radar arch sit flush in the stowed position. In this context, the assembly may also include a base to which the radar arch and the bimini arm are mounted and in which the drive system may be housed, where the bend in the bimini arm may be configured such that the bimini arm is nearly parallel with the base in the extended position, and an upper portion of the bimini arm is curved upward to support a forward end of the canopy.

The assembly may include a secondary pivot arm connected between the radar arch and the canopy. In this context, the assembly may include a resilient cord connected between the secondary pivot arm and the radar arch. The radar arch may include a bottom section having a first width and a hoop arm having a second width narrower than the first width defining a rearward edge, where the secondary pivot arm may be pivotally connected to the rearward edge.

The bimini arm may include a bottom section connected to a top section via a release pin and a pivot connector spaced from the release pin.

The assembly may include a base to which the radar arch and the bimini arm are mounted and in which the drive system may be housed, where the radar arch includes a slot recessed into a lower surface, and where the base includes an aperture through which a release pin engages the slot when the radar arch may be in the radar position. The release pin may include a spring-loaded or smart powered locking pin for releasing or exiting the aperture in the base when the radar arch is in movement and reinserting when the radar arch is either in the stowed position or the radar position.

In another exemplary embodiment, a combined radar arch and bimini top assembly includes a radar arch securable on a boat deck that is pivotable between a stowed position and a radar position, and a bimini arm cooperable with the radar arch and securable on the boat deck. The bimini arm is pivotable with the radar arch between the stowed position and the radar position, and the bimini arm is pivotable to an extended position. A canopy is connected between the bimini arm and the radar arch, and a drive system coupled with the bimini arm engages the bimini arm to drive the bimini arm among the stowed, radar and extended positions. A biasing structure connected to the radar arch biases the radar arch toward the radar position. The radar arch and the bimini arm are individually actuated while also being used in tandem to deploy the canopy, the radar arch, and the bimini arm.

BRIEF DESCRIPTION OF THE DRAWINGS

These and other aspects and advantages will be described in detail with reference to the accompanying drawings, in which.

DETAILED DESCRIPTION

With reference to FIGS. 1-4, the combined radar arch and bimini top assembly 10 includes a radar arch 12 securable on a boat deck. The radar arch 12 is pivotable between the stowed position shown in FIG. 2 and the radar position shown in FIG. 3.

The assembly 10 also includes a bimini arm 14 cooperable with the radar arch 12 and securable on the boat deck. The bimini arm 14 is pivotable with the radar arch 12 between the stowed position and the radar position. The bimini arm 14 is further pivotable to the extended position shown in FIG. 1.

Figure 5:
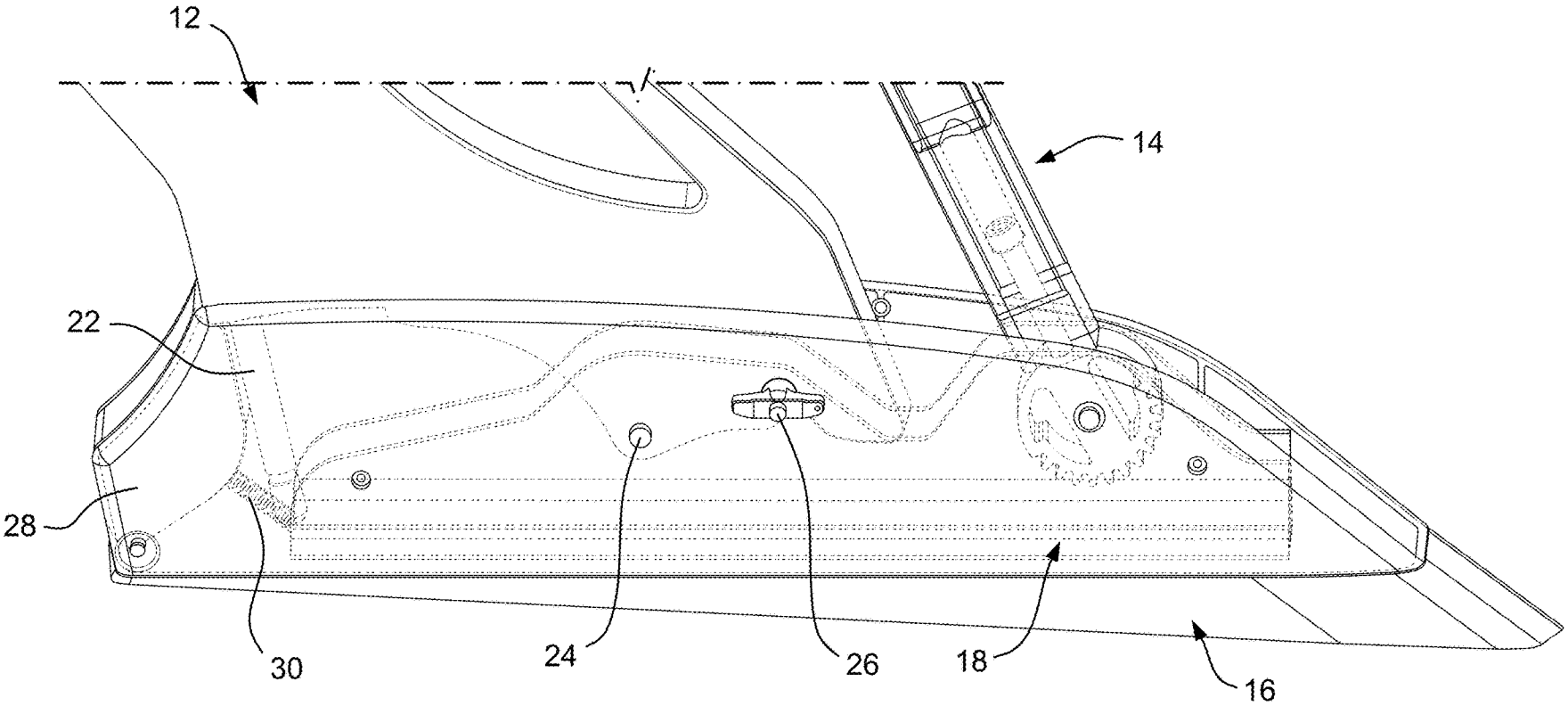
FIG. 5 is a close-up view of the base and driving components.

In some embodiments, the radar arch 12 and the bimini arm 14 are securable to the boat deck via a base 16. With reference to FIG. 5, the base 16 is secured to the boat deck in any suitable manner and includes components for supporting and displacing the radar arch 12 and the bimini arm 14. The base 16 houses a drive system 18 that is coupled with the bimini arm 14. Any suitable drive system may be used, and further details of the drive system will not be described. An exemplary mechanism for deploying and retracting the bimini arm 14 is described in U.S. Pat. No. 7,389,737, the contents of which are hereby incorporated by reference. The drive system 18 engages the bimini arm 14 to drive the bimini arm among the stowed, radar and extended positions.

A canopy 20 is connected between the bimini arm 14 and the radar arch 12.

In some embodiments, a forward end of the radar arch 12 is connected with a biasing structure to bias the radar arch 12 toward the radar position. In an exemplary embodiment, a gas strut 22 applies the bias force to the radar arch 12. The gas strut 22 may be connected between any fixed point and the radar arch 12 and is shown in FIG. 5 connected to the base 16 or a forward end of the drive system 18. In other embodiments, the biasing structure could be a spring device or other known biasing mechanism.

An opposite end of the radar arch 12 is connected to the base 16 via a pivot pin 24. The radar arch 12 may be locked in the radar position via a quick release pin 26 that is spaced from the pivot pin 24 and includes a handle. The quick release pin 26 provides for manual override of the radar arch 12 back to the stowed position.

A front closure 28 may be included at the front end of the base 16 forward of the radar arch 12 and the strut 22 to cover a gap at the front of the base 16 and protect the strut 22 from the elements. The front closure 28 may be spring-loaded via a spring 30 to bias the front closure 28 toward an upright position. With the assembly in the stowed position shown in FIG. 2, the front closure 28 is pivoted by the radar arch 12 away from the base 16. In FIG. 3, with the assembly in the radar position, the front closure 28 is pivoted to the upright orientation by the spring 30. That is, with particular reference to FIG. 5, as the radar arch 12 is pivoted from the radar position (shown in FIG. 5) to the stowed position, the forward side of the radar arch 12 will engage the front closure 28 and displace the front closure 28 away from the base 16. When the radar arch 12 is returned to the radar position, the spring 30 draws the front closure 28 back to the upright position shown in FIG. 5.

Figure 4:
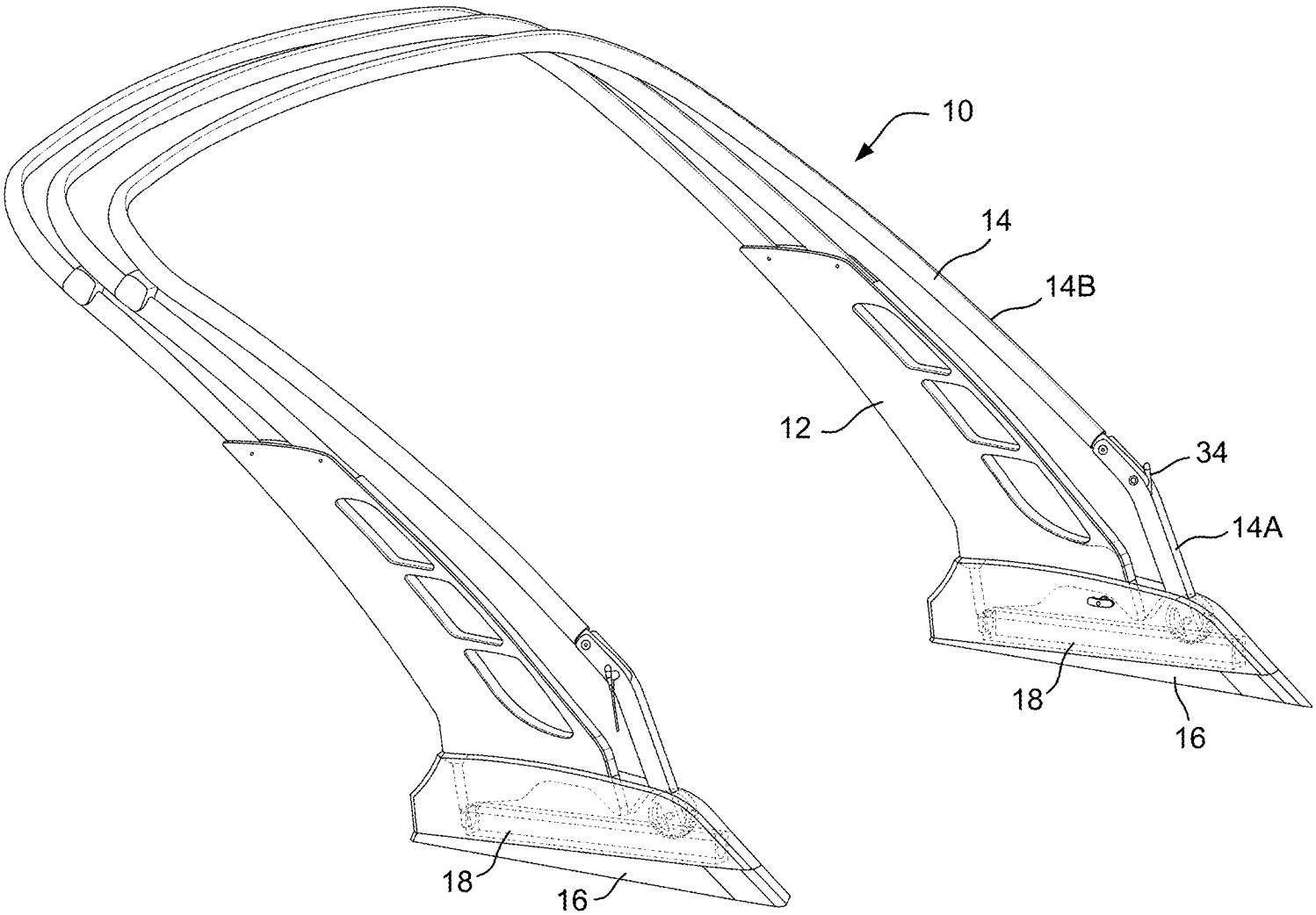
FIG. 4 is a perspective view of the assembly in the radar position.

With continued reference to FIG. 4, the radar arch 12 and bimini arm 14 are stowed in the radar position. The assembly has dual use as an aesthetic and stowable radar arch as well as a deployable bimini as separately but tandomly deployable structures.

Figure 1:
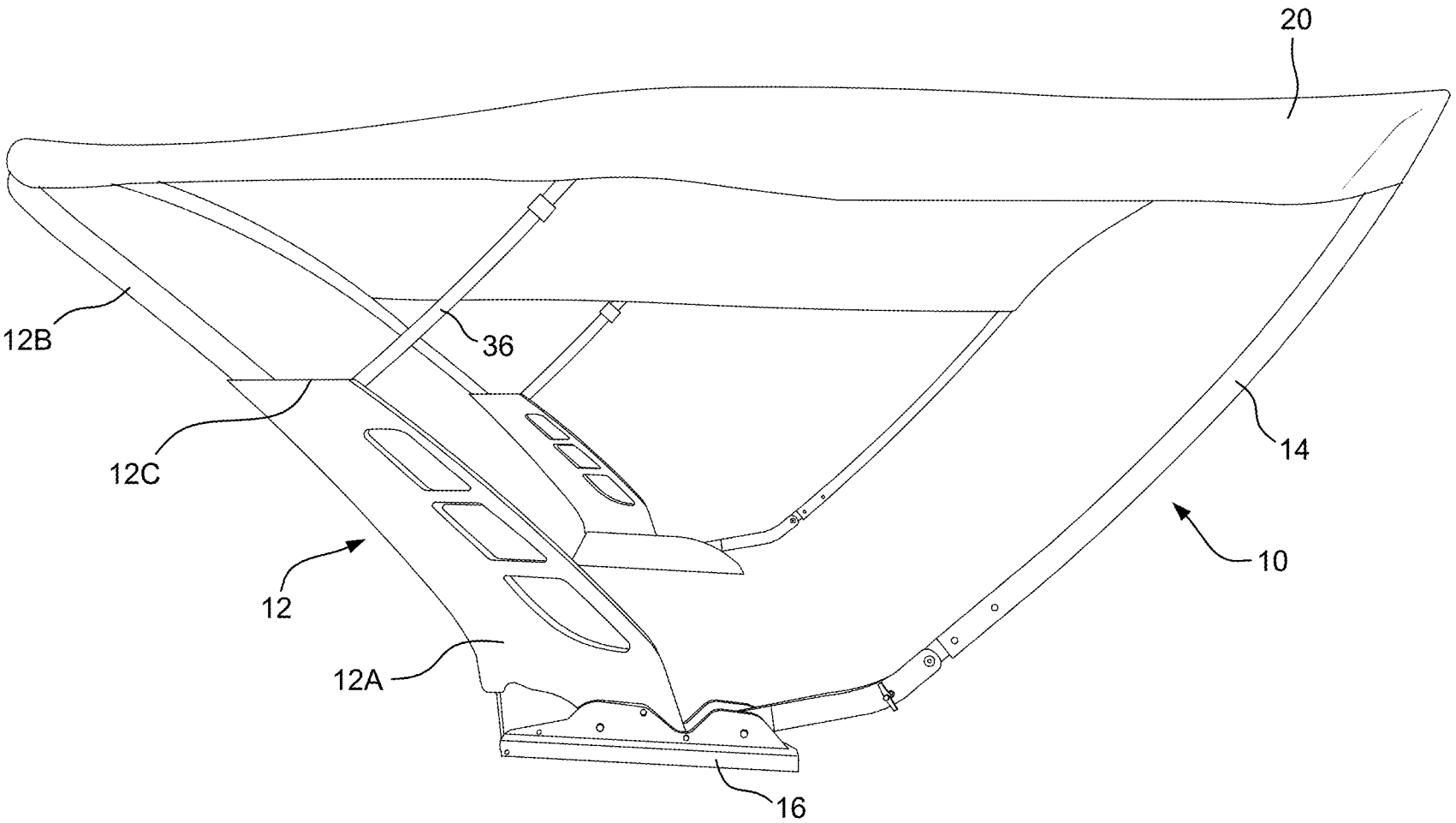
FIG. 1 shows the assembly in a fully deployed position.

The assembly may include a canopy cover or boot 32 that covers the radar arch 12, the bimini arm 14 and the canopy 20 in a retracted position. With the boot 32 in place, with reference to FIGS. 2 and 3, the radar arch 12 and the bimini arm 14 are pivotable together between the stowed and radar positions. The boot 32 prevents the bimini arm 14 from being further displaced to the extended position. When the canopy 20 is free-floating, i.e., without the boot 32 in place, the radar arch 12 and the bimini arm 14 are both free to actuate fully between stowed, radar and fully deployed positions. The fully deployed position includes the radar arch 12 in the radar position, and the bimini arm 14 in the extended position as shown in FIG. 1.

Figure 2:
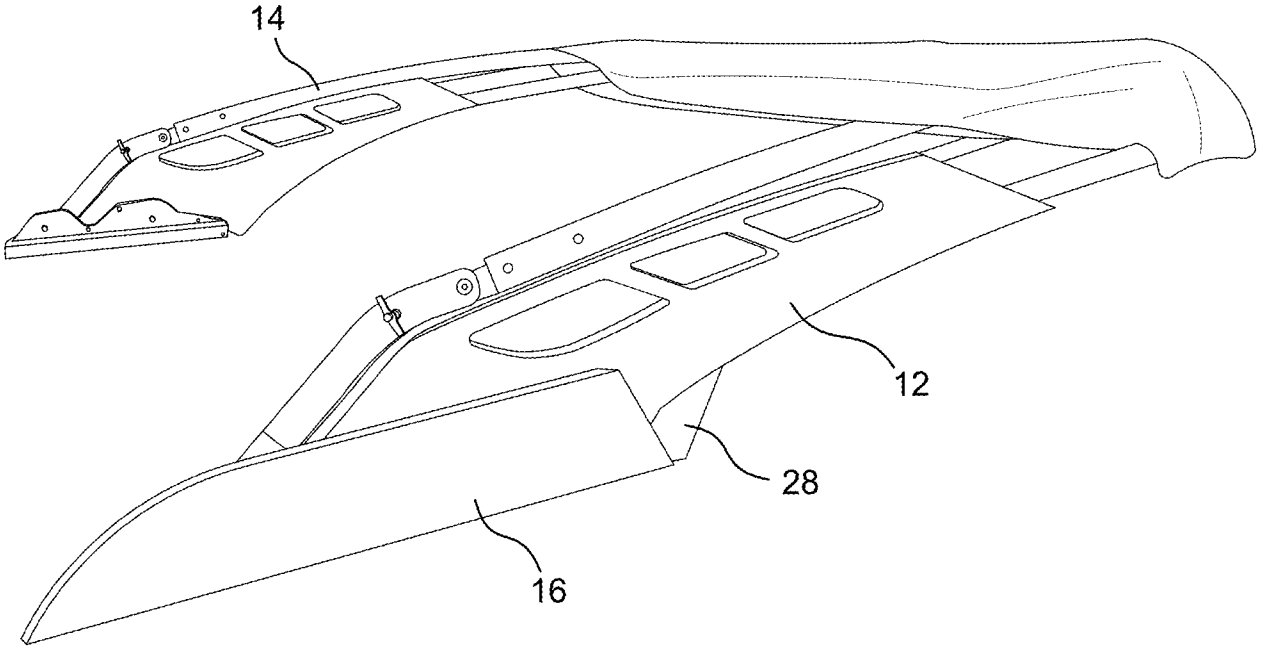
FIG. 2 shows the assembly in a stowed position.
Figure 3:
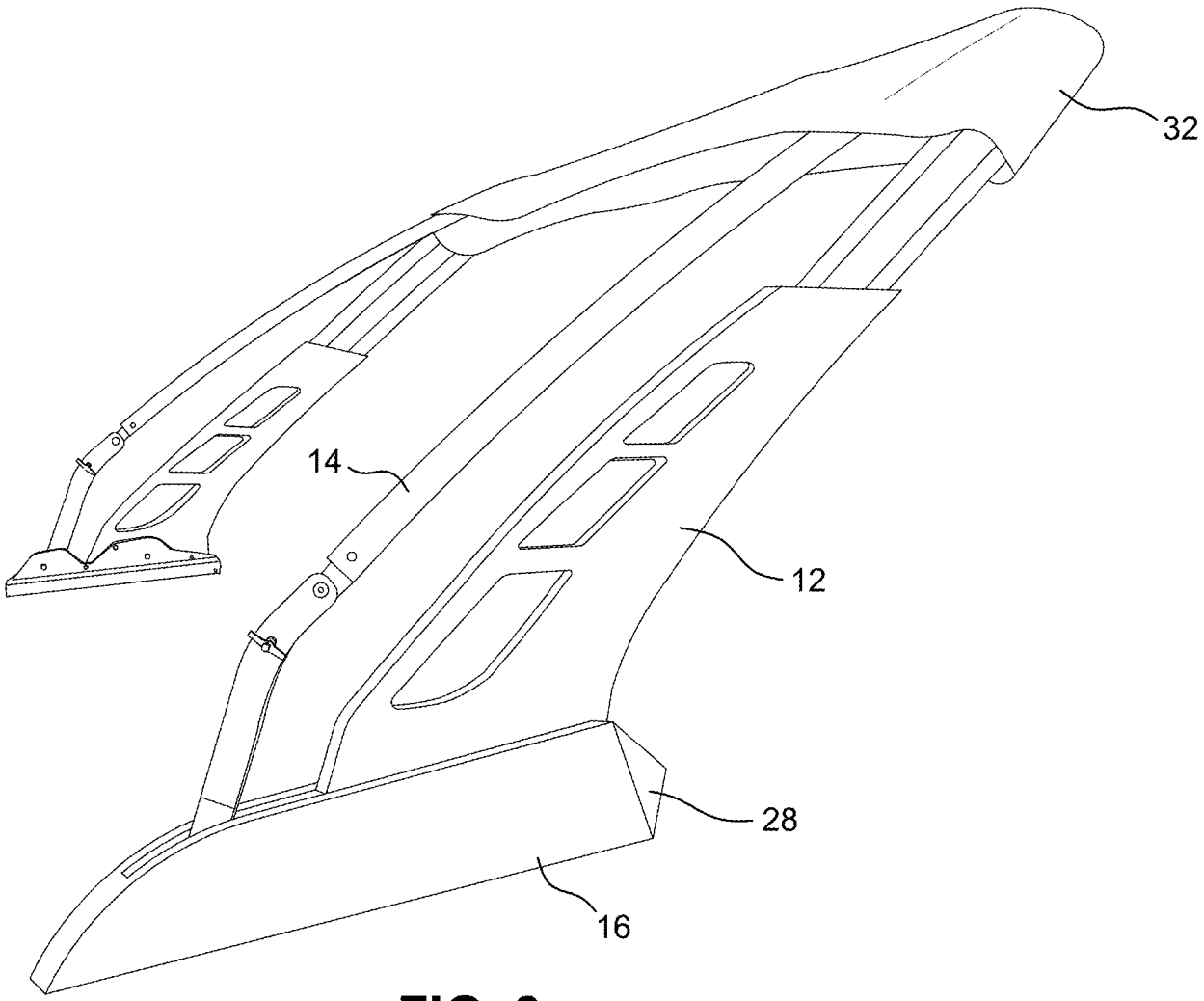
FIG. 3 shows the assembly in a radar position.

With continued reference to FIGS. 2 and 3, with the boot 32 in place, when the bimini arm 14 is actuated to the radar position by the drive system 18, the bimini arm 14 pulls the radar arch 12 since the uppermost bars of the radar arch 12 and the bimini arm 14 are booted together. The strut 22 at the front of the radar arch 12 extends and biases the radar arch 12 toward the radar position. The bimini arm 14 is actuated in the opposite direction by the drive system 18 against the bias force of the gas strut 22 to pivot the radar arch 12 back to the stowed position.

Figure 6:
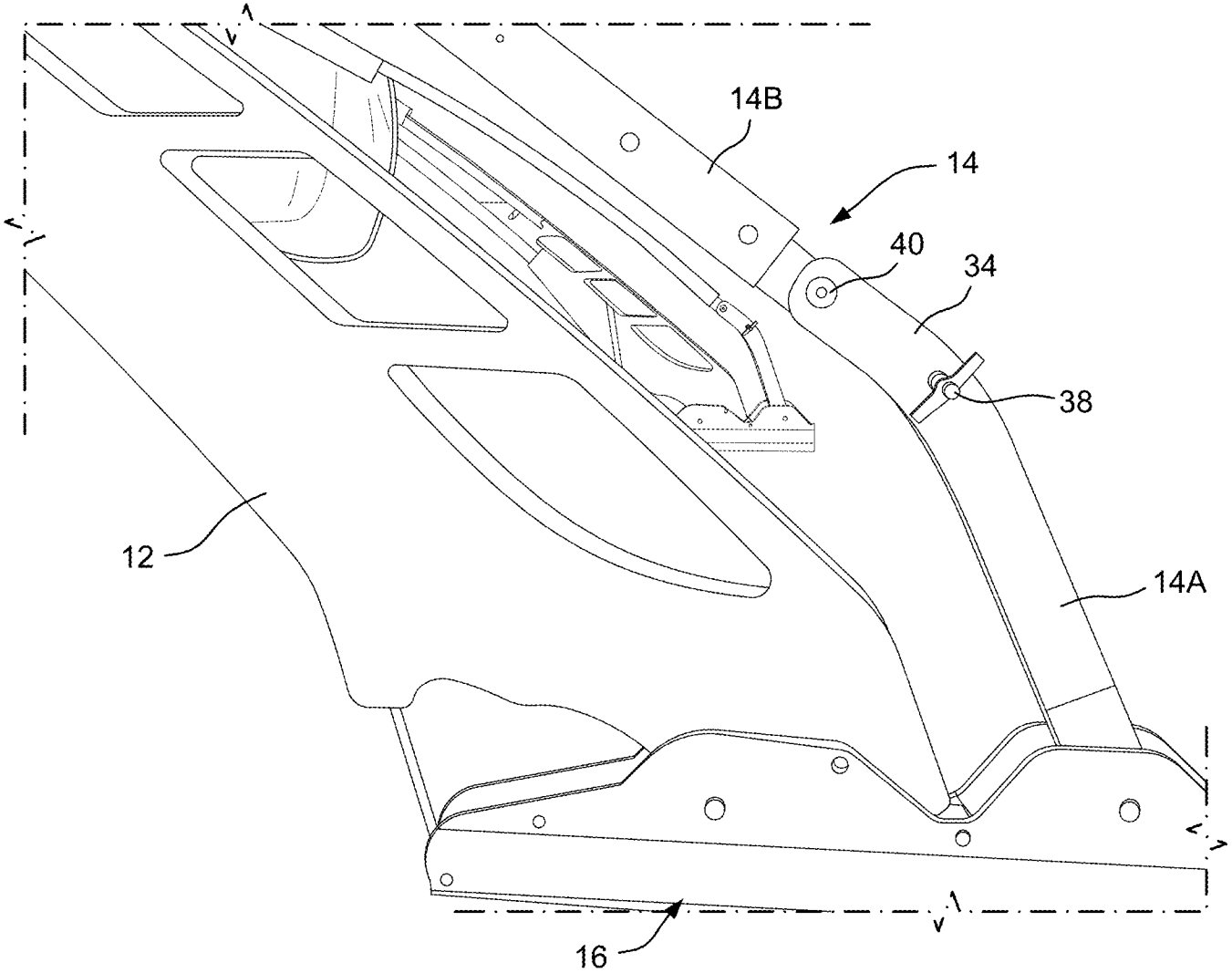
FIG. 6 is a close-up view in the radar position.

With reference to FIG. 6, a proximal end of the bimini arm 14 may include a bend 34 that corresponds to a convex or bump-out region of the proximal rearward end of the radar arch 12 so that they sit flush with each other in the stowed position and do not impede each other's arc of travel when actuating. With reference to FIG. 1, the bend 34 in the bimini arm 14 causes the bimini arm 14 to be nearly parallel with the base in the extended position with the upper portion of the bimini arm curving up to support a forward end of the canopy 20. This configuration helps to keep the bimini arm 14 from obstructing the user's view or obstructing the user's movement about the boat deck.

Without the boot 32 in place, the assembly 10 can make a full transition from the stowed position to the fully deployed position where the radar arch 12 is pivoted to the radar position and the bimini arm 14 is pivoted to the extended position. As the bimini arm 14 actuates to the fully open position, the bimini arm 14 pulls the canopy 20, which assists in pulling the radar arch 12 to the radar position in combination with the strut 22.

When the radar arch 12 has reached the radar position and the bimini arm 14 continues to actuate and pull the canopy 20 to be taut, the canopy also pivots a secondary pivot arm 36 to a deployed position. With reference to FIG. 1, the secondary pivot arm 36 is connected between the radar arch 12 and the canopy 20. The secondary pivot arm 36 is pivotable from an intermediate point on the rearward face of the radar arch 12. A resilient cord such as a bungee cord or the like may be connected between the secondary pivot arm 36 and the radar arch 12 to bias the secondary arm 36 toward the folded or stowed position when the assembly is retracting.

Figure 8:
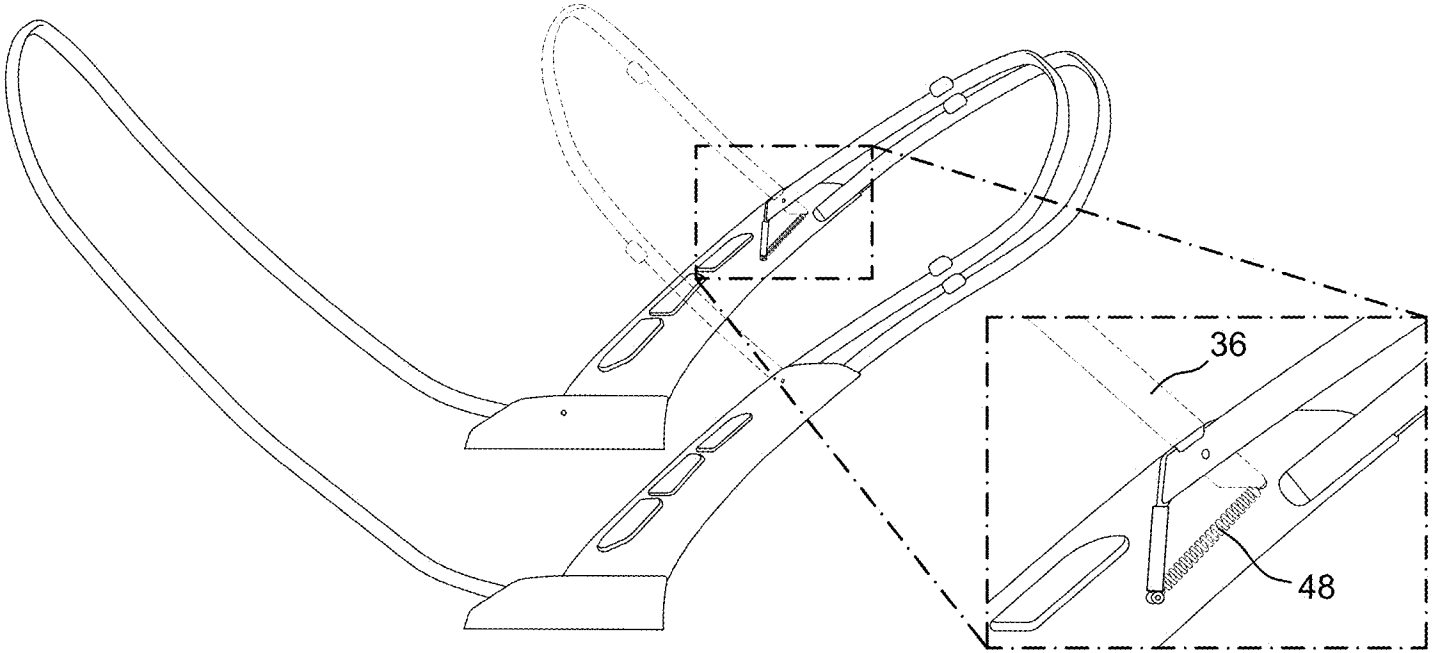
FIG. 8 shows another view of the assembly in a fully deployed position with a spring-biased secondary pivot arm.

In another embodiment shown in FIG. 8, one or more extension springs 48 may bias the secondary pivot arm 36 toward the folded or stowed position when the assembly is retracting. As shown, the spring 48 may be an extension spring mounted between a portion or a compartment within the radar arch 12 near the pivotal connection point of the secondary pivot arm 36 at one end and connected to an end of the secondary pivot arm 36 at the other end of the spring. When the assembly is extending towards the deployed position, the end of the secondary pivot arm 36 rotates and elongates the spring 48, creating tension force within the spring 48. As the assembly is retracting, the tension is released in the spring 48, which biases the secondary pivot arm 36 toward the stowed position.

In the exemplary embodiment shown in FIG. 1, the radar arch 12 comprises a "half-arch" hybrid arch and bimini top where the lower half is a solid arch and the top half is a fixed hoop arm extending from the forward edge of the arch. The secondary pivot arm 36 pivotably extends from the rearward edge. That is, the radar arch 12 includes a bottom section 12A having a first width and a hoop arm 12B having a second width narrower than the first width defining a rearward edge 12C. The secondary pivot arm 36 is pivotally connected to the rearward edge 12C. The autonomous bimini arm 14, bend 34 in the bimini arm, and "half-arch" features work in combination to be aesthetically pleasing while also being low-profile and minimally obtrusive for the user.

The fixed hoop arm 12B of the radar arch 12 or any other portion of the framework may integrate LED lights for aesthetics and visibility.

Referring again to FIG. 6, the bimini arm 14 may include a bottom section 14A connected to a top section 14B via a release pin 38 and a pivot connector 40 spaced from the release pin 38. The bottom section 14A may be forked to allow the top section 14B to rotate about the pivot pin 40 above the release aperture to pivot the upper portion 14B of the bimini arm 14 to the stowed position.

Figure 7:
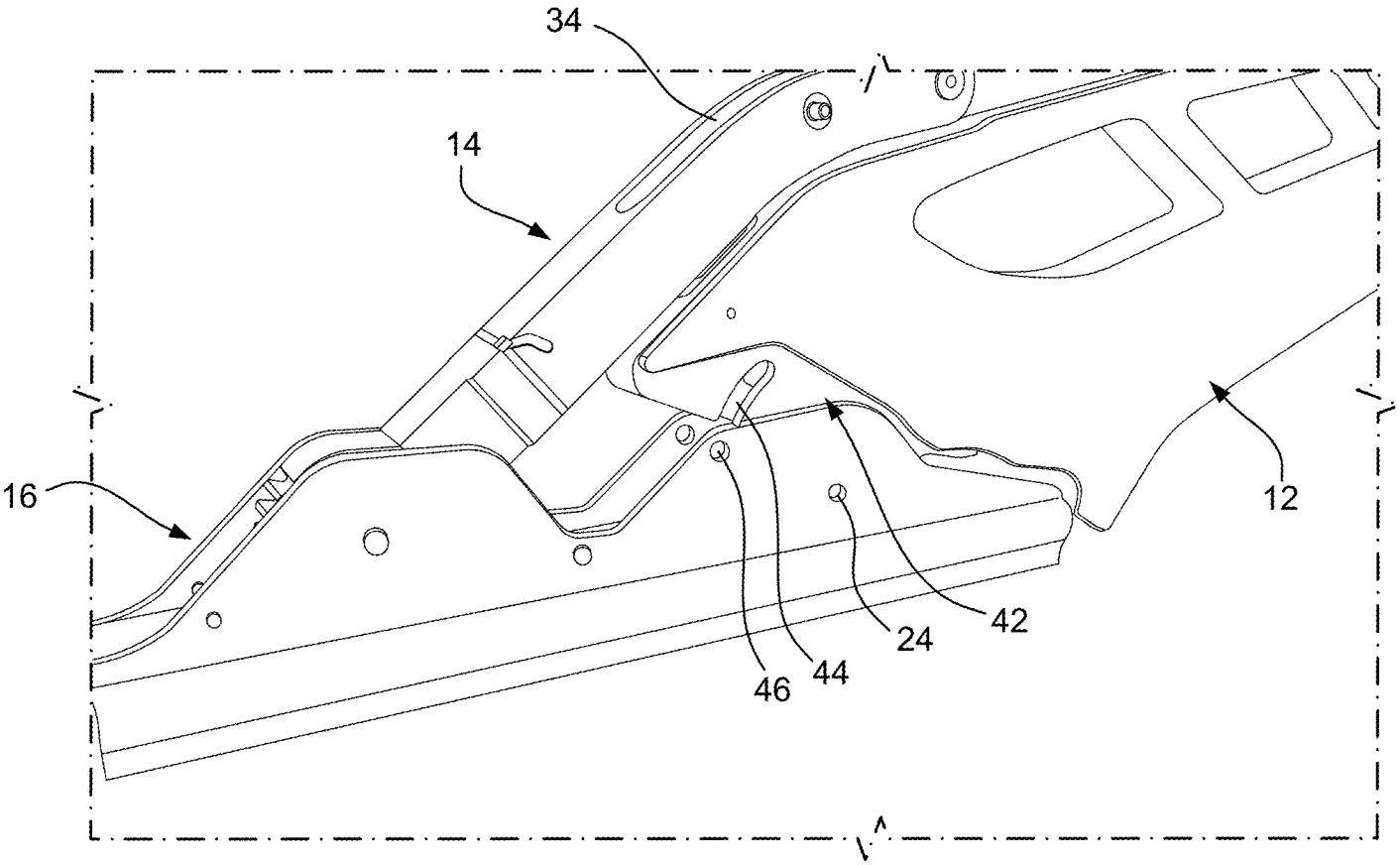
FIG. 7 is a close-up view in the stowed position.

With reference to FIG. 7, the radar arch 12 may include a block 42 with an aperture or slot 44 recessed into the lower end of the radar arch 12. Corresponding apertures 46 in the base 16 may be located forward of the radar arch pivot pin 24 to avoid binding as the radar arch 12 pivots between the stowed and radar positions. Locking apertures in the radar arch and the base are aligned for insertion of a release pin when in the radar position. In some embodiments, the radar arch may include a spring-loaded or smart-powered locking pin for releasing or exiting the locking aperture(s) when the radar arch is in movement and reinserting when the arch is either in the stowed or radar positions.

The assembly of the described embodiments provides for individually actuated components that are simultaneously used in tandem to deploy a bimini canopy along with a radar arch and bimini arm. The construction provides a different yet appealing appearance compared to existing assemblies. With the forward leaning radar arch and the bimini arm in the radar position, the assembly looks like a substantial radar arch that mimics the appearance of a more expensive component. Additionally, the bimini arm is readily deployable to provide a bimini top that is coherent and continuous with the radar arch.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A combined radar arch and bimini top assembly comprising:

a radar arch securable on a boat deck, the radar arch being pivotable between a stowed position and a radar position;

a bimini arm cooperable with the radar arch and securable on the boat deck, the bimini arm being pivotable with the radar arch between the stowed position and the radar position, the bimini arm being further pivotable to an extended position;

a canopy connected between the bimini arm and the radar arch; and a drive system coupled with the bimini arm, the drive system engaging the bimini arm to drive the bimini arm among the stowed, radar and extended positions, wherein the radar arch is biased by a bias force toward the radar position, and wherein the bimini arm displaces the radar arch via the drive system from the radar position to the stowed position against the bias force.

2. An assembly according to claim 1, further comprising a biasing structure that applies the bias force to the radar arch.

3. An assembly according to claim 1, further comprising a boot that covers the radar arch, the bimini arm, and the canopy, wherein when the boot is installed, the bimini arm is pivotable only between the stowed position and the radar position.

4. An assembly according to claim 1, further comprising a base to which the radar arch and the bimini arm are mounted and in which the drive system is housed, wherein the radar arch is connected to the base via a pivot pin.

5. An assembly according to claim 4, further comprising a gas strut that applies the bias force to the radar arch, wherein the gas strut is connected between a forward end of the radar arch and the base.

6. An assembly according to claim 4, wherein the radar arch is connected to the base with an end pin spaced from the pivot pin, the end pin including a handle to define a quick release pin.

7. An assembly according to claim 4, wherein the base comprises a front closure disposed forward of the radar arch that covers a gap at a front of the base.

8. An assembly according to claim 7, wherein the front closure is pivotable between an upright position and a collapsed position, and wherein the front closure is biased toward the upright position via a spring.

9. An assembly according to claim 1, wherein a proximal end of the bimini arm comprises a bend that corresponds to a convex region of a proximal rearward end of the radar arch such that the bimini arm and the radar arch sit flush in the stowed position.

10. An assembly according to claim 9, further comprising a base to which the radar arch and the bimini arm are mounted and in which the drive system is housed, wherein the bend in the bimini arm is configured such that the bimini arm is nearly parallel with the base in the extended position, and wherein an upper portion of the bimini arm is curved upward to support a forward end of the canopy.

11. An assembly according to claim 1, further comprising a secondary pivot arm connected between the radar arch and the canopy.

12. An assembly according to claim 11, further comprising a resilient cord connected between the secondary pivot arm and the radar arch.

13. An assembly according to claim 11, wherein the radar arch comprises a bottom section having a first width and a hoop arm having a second width narrower than the first width defining a rearward edge, and wherein the secondary pivot arm is pivotally connected to the rearward edge.

14. An assembly according to claim 1, wherein the bimini arm comprises a bottom section connected to a top section via a release pin and a pivot connector spaced from the release pin.

15. An assembly according to claim 1, further comprising a base to which the radar arch and the bimini arm are mounted and in which the drive system is housed, wherein the radar arch includes a slot recessed into a lower surface, and wherein the base includes an aperture through which a release pin engages the slot when the radar arch is in the radar position.

16. An assembly according to claim 15, wherein the release pin comprises a spring-loaded or smart powered locking pin for releasing or exiting the aperture in the base when the radar arch is in movement and reinserting when the radar arch is either in the stowed position or the radar position.

17. A combined radar arch and bimini top assembly comprising:

a radar arch securable on a boat deck, the radar arch being pivotable between a stowed position and a radar position;

a bimini arm cooperable with the radar arch and securable on the boat deck, the bimini arm being pivotable with the radar arch between the stowed position and the radar position, the bimini arm being further pivotable to an extended position;

a canopy connected between the bimini arm and the radar arch;

a drive system coupled with the bimini arm, the drive system engaging the bimini arm to drive the bimini arm among the stowed, radar and extended positions; and a biasing structure connected to the radar arch and biasing the radar arch toward the radar position, wherein the radar arch and the bimini arm are individually actuated while also being used in tandem to deploy the canopy, the radar arch, and the bimini arm.

* * * * *